US008055144B2

(12) United States Patent
Park

(10) Patent No.: US 8,055,144 B2
(45) Date of Patent: Nov. 8, 2011

(54) IMAGE FORMING APPARATUS AND CONTROL METHOD THEREOF

(75) Inventor: Kwang Sung Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 667 days.

(21) Appl. No.: 12/046,735

(22) Filed: Mar. 12, 2008

(65) Prior Publication Data

US 2008/0226323 A1 Sep. 18, 2008

(30) Foreign Application Priority Data

Mar. 15, 2007 (KR) ..... 10-2007-0025624

(51) Int. Cl.
*G03G 15/00* (2006.01)
*G03G 15/20* (2006.01)

(52) U.S. Cl. ..... 399/45; 399/42; 399/44; 399/68; 399/320; 399/334

(58) Field of Classification Search ..... 399/44, 399/45, 68, 334
See application file for complete search history.

(56) References Cited

U.S. PATENT DOCUMENTS 5,135,688 A * 8/1992 Nakamura et al. ..... 264/40.6
5,287,154 A * 2/1994 Nakai et al. ..... 399/42
5,311,268 A * 5/1994 Ohzeki et al. ..... 399/42
5,327,196 A * 7/1994 Kato et al. ..... 399/58
5,331,384 A * 7/1994 Otsuka ..... 399/45
5,497,449 A * 3/1996 Miyazawa ..... 706/52
5,835,681 A * 11/1998 Kaneko et al. ..... 706/8
6,101,343 A * 8/2000 Satoh et al. ..... 399/50
6,772,085 B2 * 8/2004 Watkins et al. ..... 702/130
6,823,150 B1 * 11/2004 Cao et al. ..... 399/69
7,218,873 B2 * 5/2007 Iwasaki et al. ..... 399/68
7,313,339 B2 * 12/2007 Nishiyama ..... 399/68
7,778,563 B2 * 8/2010 Eun et al. ..... 399/68
7,965,953 B2 * 6/2011 Boyatt et al. ..... 399/44
2004/0126123 A1 * 7/2004 Koga et al. ..... 399/24
2007/0061023 A1 * 3/2007 Hoffberg et al. ..... 700/83
2007/0112475 A1 * 5/2007 Koebler et al. ..... 701/1
2008/0055355 A1 * 3/2008 Hersch et al. ..... 347/19
2008/0226323 A1 * 9/2008 Park ..... 399/68

FOREIGN PATENT DOCUMENTS

CN 1770039 5/2006
JP 8-016043 1/1996

OTHER PUBLICATIONS

Office Action issued by State Intellectual Property Office in Chinese Patent Application No. 200810083613.0 on Jul. 10, 2009.

* cited by examiner

*Primary Examiner* — David Gray
*Assistant Examiner* — Francis Gray
(74) *Attorney, Agent, or Firm* — Staas & Halsey LLP

(57) ABSTRACT

A printing speed is adaptively set using Fuzzy inference, based on various printing environments including a printing medium width and the average amount of printing, so that the internal temperature of an apparatus can be stably maintained, and the use convenience can be enhanced.

26 Claims, 6 Drawing Sheets

IMAGE FORMING APPARATUS AND CONTROL METHOD THEREOF

CROSS-REFERENCE TO RELATED APPLICATION

This application claims the benefit of Korean Application No. 2007-25624, filed Mar. 15, 2007, in the Korean Intellectual Property Office, the disclosure of which is incorporated herein by reference.

BACKGROUND OF THE INVENTION

1. Field of the Invention

Aspects of the present invention relate to an image forming apparatus and a method of using the same.

2. Description of the Related Art

An electro-photographic image forming apparatus uses a fusing process, in which heat and pressure are applied to a printing medium having a transferred toner image, in order to form a high-quality image. Fusing performance is directly affected by a fusing temperature. Typically, when power is supplied, a fusing temperature is increased through a preheating process, and a heating operation of a fusing apparatus is controlled based on the fusing temperature, which is set in accordance with an operational environment (temperature and humidity).

One factor to be taken into consideration when controlling a fusing temperature is how to properly maintain the internal temperature of an apparatus. If a printing medium, heated by passing through a fusing device, is discharged to the outside of the apparatus, heat inside the apparatus is also discharged, and thus the internal temperature may decrease. Accordingly, a printing speed related to the discharge of a printing medium exerts a significant influence upon the internal temperature control of the apparatus.

According to the related art, when the internal temperature of an apparatus becomes high, a printing speed is decreased, such that the internal temperature is properly maintained. If a previously set printing speed is not normal, because the width of a printing medium, set by a user for a printing operation, does not coincide with a width of a printing medium actually used, the internal temperature of an apparatus may increase, resulting in overheating.

In order to solve such a problem, a plurality of temperature sensors are installed at a fusing unit, and the width of a printing medium entering the fusing device is estimated, based on temperature differences detected by the temperature sensors. When a width set by a user (user set width) does not coincide with the width of an actually used printing medium, according to an actual printing medium width detected using a printing medium width sensor, the printing speed may be altered. For example, when the user set width is wider than the width of a non-standardized printing medium that is actually used, the preset printing speed is decreased, such that internal components of an apparatus are protected from excessive heat produced during fusing.

When a printing speed is decreased, while the printing operation is being performed using a non-standardized printing medium, a user who wants a quick printing operation may be dissatisfied. When the amount of printing is not great the apparatus is not overheated, even though a non-standardized printing medium is used. However, if the printing speed is set on the assumption of using the non-standardized printing medium, requirements of users who request a prevention of overheating and a restriction in the decrease of the printing speed, may not be satisfied.

In order to solve such problems, a printing speed of a non-standardized printing medium can be changed, according to the amount of printing in a printing operation. That is, a printing speed is increased in an initial printing operation, and then is decreased when the amount of printing exceeds a preset amount of printing. When such a method is employed, the key point is to set the amount of printing suitable for controlling the printing speed. However, since various printing environments exist, it is difficult to satisfy various users who prefer device stability, by preventing overheating, or who prefer a quicker printing speed.

SUMMARY OF THE INVENTION

Aspects of the present invention relate to an image forming apparatus to dynamically set a printing speed, based on various printing environments, and a control method thereof.

Aspects of the present invention relate to an image forming apparatus comprising: a fusing unit provided with a fusing heater; a temperature detector to detect a fusing temperature depending on an operation of the fusing unit; a printing environment information unit to provide printing environment information; a Fuzzy inference unit to provide printing speed setup information obtained through Fuzzy inference, using information on the temperature detected by the temperature detector and the printing environment information; and a printing speed setup unit to set a printing speed, based on the printing speed setup information.

According to aspects of the present teachings, the temperature detector comprises a main temperature sensor to detect a temperature of a central portion of a heating roller, which is heated by the fusing unit, and a sub-temperature sensor to detect a temperature of one end portion of the heating roller.

According to aspects of the present teachings, the printing environment information unit provides information on a width of a printing medium used for a printing operation (print job) and an average amount of printing.

According to aspects of the present teachings, the printing environment information unit comprises a printing medium width sensor to detect the width of the printing medium.

According to aspects of the present teachings, the printing environment information unit comprises a printing medium width setup unit to set a width of a printing medium using the temperature detected by the temperature detector.

According to aspects of the present teachings, the printing environment information unit comprises a printing amount storing unit to store an amount of printing when a printing operation is performed, and an average printing amount calculation unit to calculate an average amount of printing, based on an amount of printing that has been previously stored.

According to aspects of the present teachings, the average printing amount calculation unit calculates an average amount of printing, by selecting printing information from the total amount of printing that has been previously stored, in which the printing information comprises an amount of printing (pages of previous print jobs) that was recently performed.

According to aspects of the present teachings, the Fuzzy inference unit comprises an operator to calculate membership functions relative to an average amount of printing, according to Fuzzy control rules, in which the average amount of printing is calculated based on a temperature of a central portion of a heating roller, a temperature of an end portion of the heating roller, a width of a printing medium used for a printing operation, and an amount of printing that has been previously stored.

According to aspects of the present teachings, the Fuzzy inference unit uses Fuzzy control rules, such that the printing speed is increased in an early stage of a printing operation, and then the printing speed is decreased based on a printing environment.

According to aspects of the present teachings, an image forming apparatus is provided, comprising: a fusing unit provided with a fusing heater; a main temperature sensor to detect a temperature of a central portion of a heating roller heated by the fusing unit; a sub-temperature sensor to detect a temperature of an end portion of the heating roller; a printing medium width sensor to detect a width of a printing medium used for a printing operation; a printing amount storing unit to store an amount of printing when the printing operations (print jobs) are performed; an average printing amount calculation unit to calculate an average amount of printing, based on amount of printing stored in the printing amount storing unit; a Fuzzy inference unit to output printing speed setup information, by using an operator to calculate membership functions, according to Fuzzy control rules, in which the membership functions are relative to the temperature detected by the main temperature sensor, the temperature detected by the sub-temperature sensor, the width of the printing medium detected by the printing medium width sensor, and the average amount of printing calculated by the average printing amount calculation unit; and a printing speed setup unit to set a printing speed based on the printing speed setup information.

According to aspects of the present teachings, there is provided an image forming apparatus comprising: a fusing unit provided with a fusing heater; a main temperature sensor to detect a temperature of a central portion of a heating roller heated by the fusing heater; a sub-temperature sensor to detect a temperature of an end portion of the heating roller; a printing medium width setup unit to set a width of a printing medium used for a printing operation, based on a difference between temperature detected by the main temperature sensor and temperature detected by the sub-temperature sensor; a printing amount storing unit to store an amount of printing when the printing operation is performed; an average printing amount calculation unit to calculate an average amount of printing, based on the amount of printing stored in the printing amount storing unit; a Fuzzy inference unit to output printing speed setup information, by using an operator to calculate membership functions according to Fuzzy control rules, in which the membership functions are relative to the temperature detected by the main temperature sensor, the temperature detected by the sub-temperature sensor, the width of the printing medium set by the printing medium width setup unit, and the average amount of printing calculated by the average printing amount calculation unit; and a printing speed setup unit to set a printing speed, based on the printing speed setup information.

According to aspects of the present teachings, there is provided a method for controlling an image forming apparatus having a plurality of temperature sensors to detect a temperature of a central portion and an end portion of a heating roller heated by a fusing heater, the method comprising: setting a fusing temperature; driving the fusing unit to reach the set fusing temperature; setting a printing speed through Fuzzy inference according to information on the temperature detected by the temperature sensors, a width of a printing medium used for a printing operation, and an average amount of printing; and controlling a printing speed based on the set printing speed.

According to aspects of the present teachings, during the setting of the printing speed, Fuzzy control rules are applied, such that the printing speed is increased in an early stage of the printing operation, and in order to prevent the fusing temperature from exceeding the set temperature, the printing speed is decreased, based on a printing environment.

According to aspects of the present teachings, the information on the detected temperature comprises the temperature of the central portion and the end portion of the heating roller heated by the fusing heater.

According to aspects of the present teachings, the width of the printing medium is set, based on a difference between the temperature of the central portion and the temperature of the end portion.

According to aspects of the present teachings, the width of the printing medium is detected by a printing medium width sensor.

According to aspects of the present teachings, the average amount of printing is calculated based on print job information stored when the printing operations are performed. The print job information can include sizes of the print jobs.

According to aspects of the present teachings, the average amount of printing is calculated based on a portion of the print job information, relating to a number of most recent print jobs performed.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
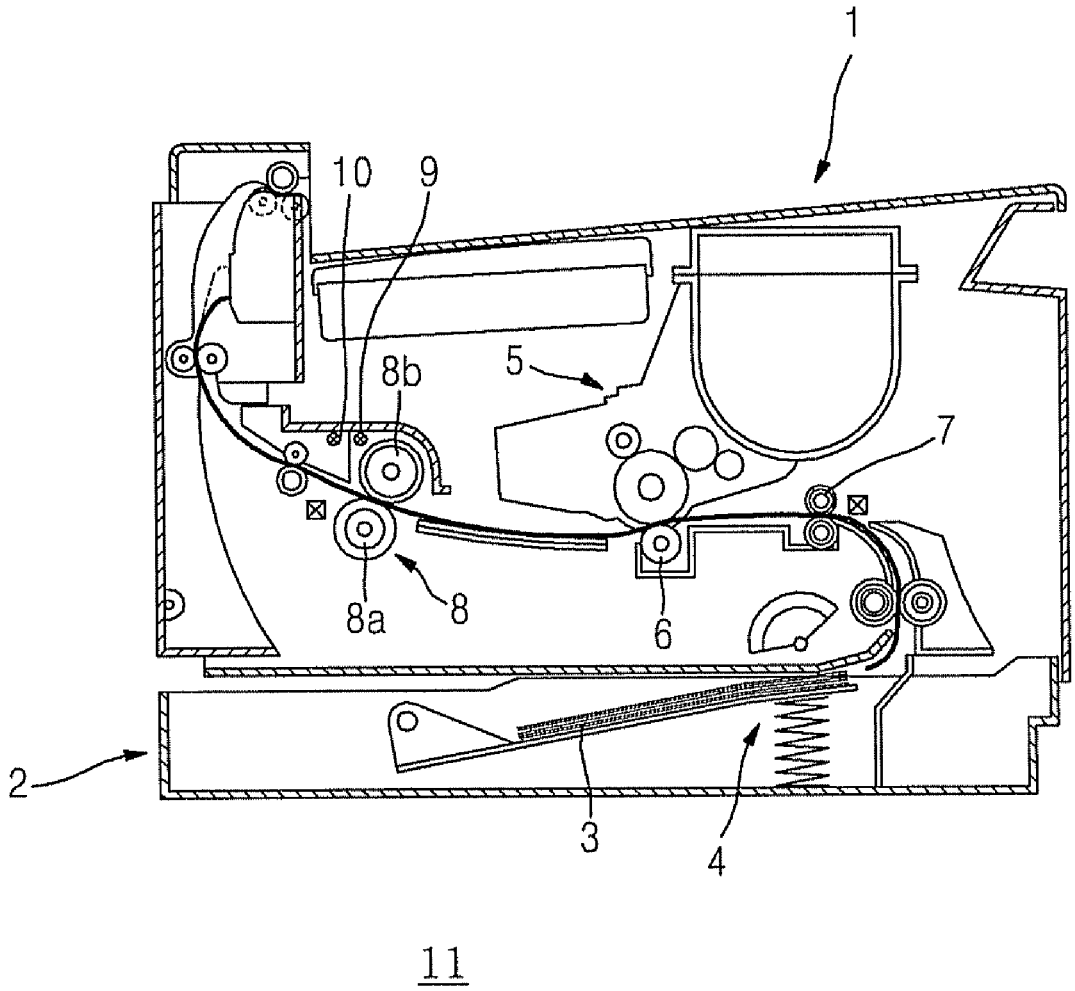
FIG. 1 is a sectional view illustrating an internal structure of an image forming apparatus, according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

As illustrated in FIG. 1, the image forming apparatus 11, according to an exemplary embodiment of the present invention, comprises a body 1, and a printing medium cassette 2 installed at a lower portion of the body 1 to store the printing media. Herein, a printing medium refers to any printable material, for example, paper and transparency sheets.

The image forming apparatus 11 comprises: a printing medium feeding unit 4 to supply single sheets of printing medium 3; to a developing unit 5 to develop an electrostatic latent image formed on a photoreceptor into a toner image; a feed roller 7 to shift the fed printing medium 3 to the developing unit 5; a transfer roller 6 to transfer the developed toner image to the printing medium 3; and a fusing unit 8 having a pressing roller 8*a* and a heating roller 8*b* to apply pressure and heat to the printing medium 3, on which the toner image is transferred.

The image forming apparatus 11 includes, a main temperature sensor 9 and a sub-temperature sensor 10 installed at the fusing unit 8, in order to detect fusing temperatures. The main temperature sensor 9 and the sub-temperature sensor 10 can be collectively referred to a temperature detection unit 13. The temperature sensors 9 and 10 provide temperature signals to a printing speed controller 100, shown in FIG. 2.

Figure 3:
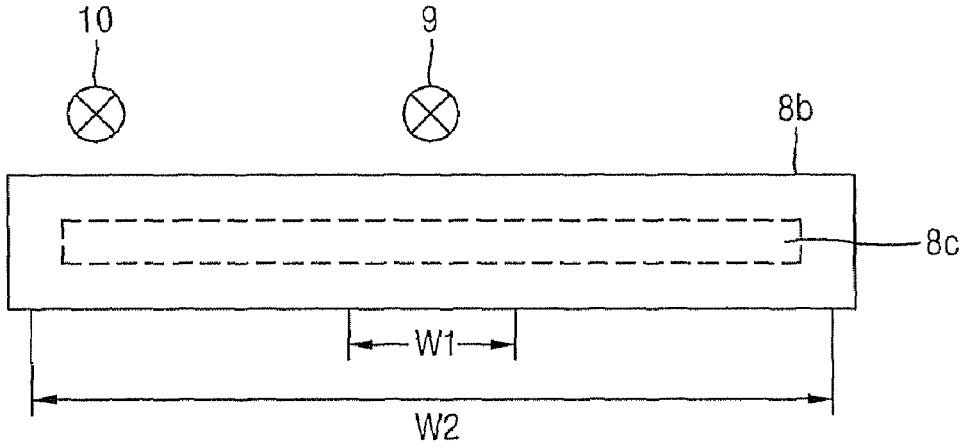
FIG. 3 is a diagram of a main temperature sensor and a sub-temperature sensor installed at a central portion and an end portion of a heating roller, according to an exemplary embodiment of the present invention.

As illustrated in FIG. 3, the heating roller 8*b* comprises at least one fusing heater 8*c* to heat the heating roller 8*b*, under the control of the printing speed controller 100. The printing speed controller 100 adaptively sets a printing speed, using Fuzzy inference, and controls a printing operation, based on the set printing speed. The set printing speed is determined in accordance with a printing environment. The printing environment can include, for example, the use or non-use of a standardized printing medium, and/or the average amount of printing. A description will be given putting emphasis on the printing speed controller 100.

Figure 2:
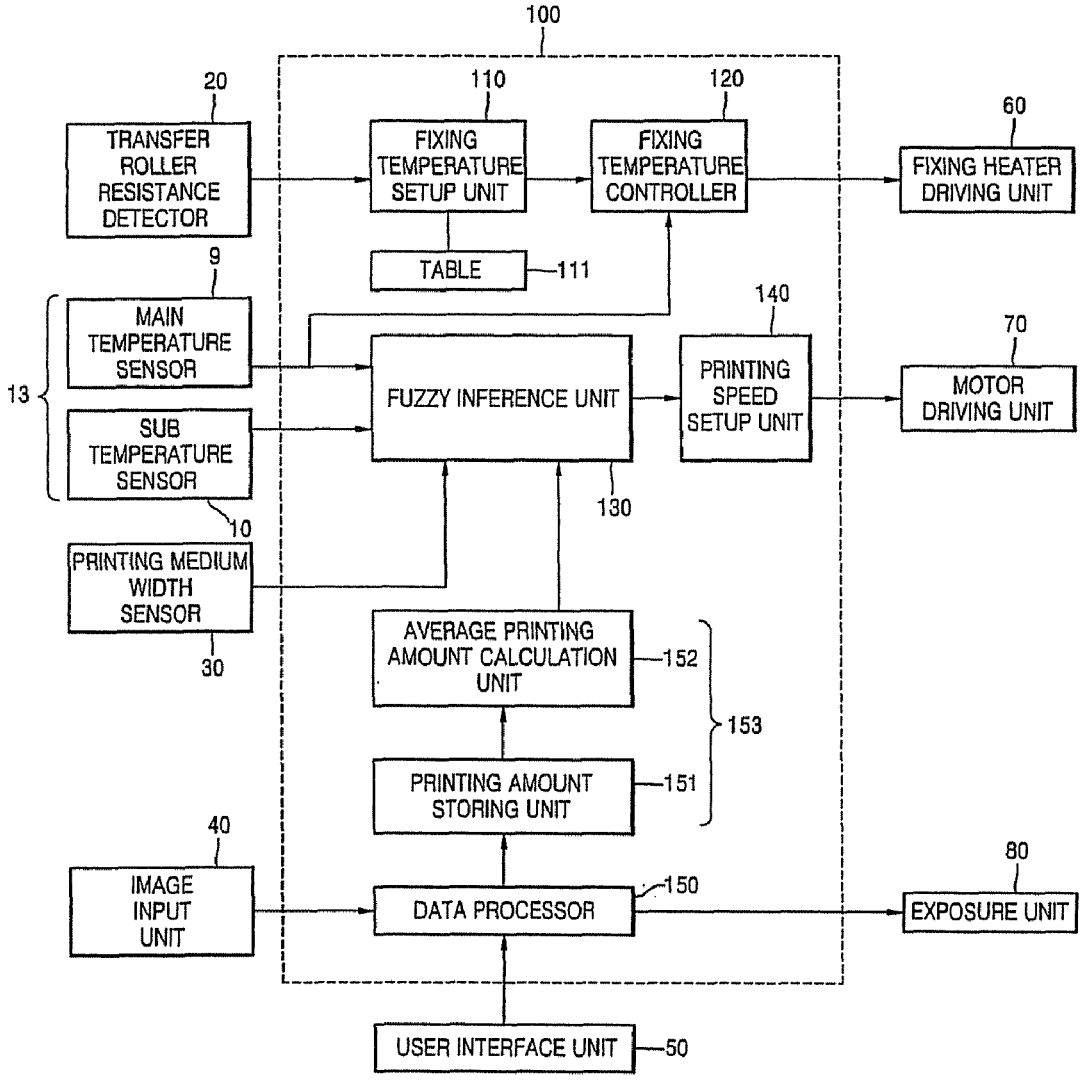
FIG. 2 is a block diagram of an image forming apparatus, according to an exemplary embodiment of the present invention.

Referring to FIG. 2, a transfer roller resistance detector 20 detects a resistance change, according to the voltage of power applied to the transfer roller 6, and provides detection resistance signals to a fusing temperature setup unit 110.

The fusing temperature setup unit 110 sets a fusing temperature corresponding to the operation environment of the apparatus 11, according to the detection resistance signals received from the transfer roller resistance detector 20. The fusing temperature setup unit 110 sets a fusing temperature, with reference to a table 111. The table 111 stores information on fusing temperatures, relative to an operational environment of the apparatus, in correspondence with the values of resistance of the transfer roller 6. The operation environment can relate to a high temperature/high humidity, a normal temperature/normal humidity, and a low temperature/low humidity, for example.

The fusing temperature setup unit 110 provides fusing temperature setup information to a fusing temperature controller 120. The fusing temperature controller 120 provides a fusing heater driving unit 60 with heater control signals, to turn on/off the fusing heater 8*c*, based on the set fusing temperature, and the temperature of the heating roller 8*b* detected through the main temperature sensor 9. The fusing heater driving unit 60 drives the fusing heater 8*c*. The heating operation of the fusing heater continues until the fusing temperature, set corresponding to the temperature and humidity of the apparatus, reaches a predetermined level.

As illustrated in FIG. 3, the main temperature sensor 9 is installed at a central position of the heating roller 8*b*, in the longitudinal direction of the heating roller 8*b*, and provides a Fuzzy inference unit 130 with temperature detection signals, obtained by detecting the temperature of the central portion of the heating roller 8*b*.

The sub-temperature sensor 10 is installed at one end of the heating roller 8*b*, in a longitudinal direction of the heating roller 8*b*, and provides the Fuzzy inference unit 130 with temperature detection signals, obtained by detecting the temperature of the end portion of the heating roller 8*b*.

As illustrated in FIG. 2, a printing medium width sensor 30 provides the Fuzzy inference unit 130 with printing medium width detection signals, obtained by detecting the width of a printing medium entering between the heating roller 8*b* and the pressing roller 8*a*. For example, the printing medium width detection signals are used to recognize the size of a printing medium, in the case where a non-standardized printing medium, having a very narrow width W1 is used, or a standardized printing medium having a wide width W2 is used.

An image input unit 40 provides a data processor 150 with image data scanned through a scanner, or received through a host computer. The data processor 150 converts the image data, received through the image input unit 40, into printable printing data, in response to a user setup command received through a user interface unit 50, and provides the printing data to an exposure unit 80. The exposure unit 80 radiates a light beam, corresponding to the printing data, to form an electrostatic image on a photoreceptor.

The data processor 150 stores information on an amount of printing (print job sizes), in a printing amount storing unit 151, when a printing operation (print job) is performed. The printing amount storing unit 151 provides an average printing amount calculation unit 152 with the information on the amount of printing. The printing amount storage unit 151 and the average printing amount calculation unit 152 can be collectively referred to as a printing environment information unit 153.

The average printing amount calculation unit 152 calculates the average amount of printing (average print job size), by dividing the accumulated amount of printing (printed pages) by the number of printings (print jobs), based on the information received from the printing amount storing unit 151. The average printing amount calculation unit 152 provides the Fuzzy inference unit 130 with information on the average amount of printing. In order to reflect a current printing environment, the average printing amount calculation unit 152 can calculate the average amount of printing, based on information on the latest amount of printing (most recent print jobs), instead of using all of the information on the amount of printing received. For example, the average printing amount calculation unit 152 calculates the average amount of printing, based on information on the ten most recent print jobs. The average amount of printing can refer to an average number of pages printed per print job.

The Fuzzy inference unit 130 adaptively sets a printing speed, using preset Fuzzy control rules, and provides a printing speed setup unit 140 with printing speed setup information. The printing speed setup unit 140 controls a printing speed for a motor, based on the received printing speed setup information, and provides a motor driving unit 70 with motor driving signals to reach the set printing speed. The motor driving unit 70 drives at least one motor, which drives various rollers picking up and carrying a printing medium and/or other rollers to develop, transfer, and fuse images, at the set printing speed.

Figure 4:
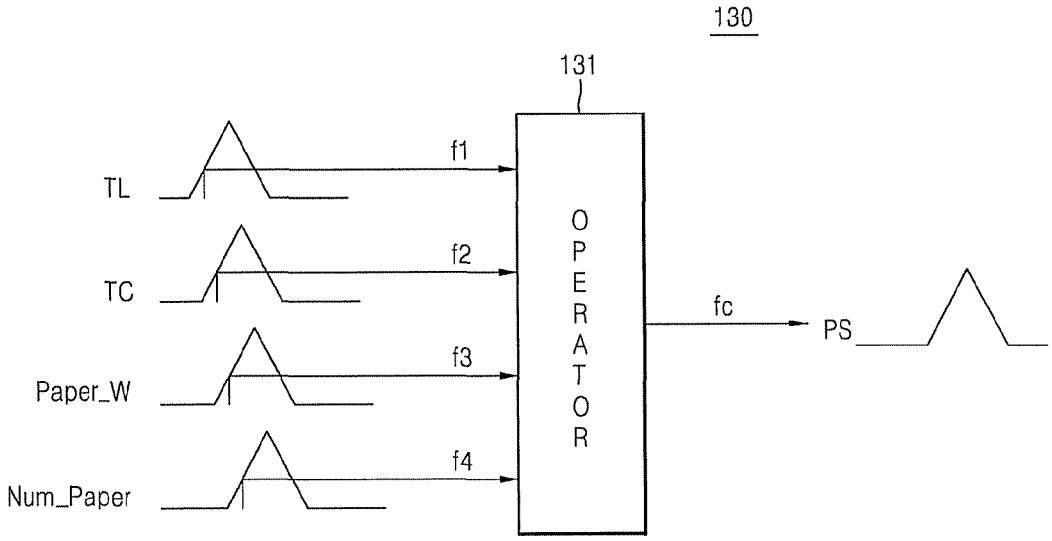
FIG. 4 is a diagram illustrating an operation in which a Fuzzy inference unit sets a printing speed, according to an exemplary embodiment of the present invention.

As illustrated in FIG. 4, the Fuzzy inference unit 130 comprises: first to fourth input membership functions TL, TC, Paper_W and Num_Paper; an operator 131; and a fifth output membership function PS. The Fuzzy inference unit 130 sets a printing speed, through a Takagi-Suseno-Kang (TSK) Fuzzy inference system, using the membership functions and the operator 131.

As the first membership function TL assigns "low", "proper", or "high" to a temperature detected through the sub-temperature sensor 10, a first matching value f1, corresponding to the temperature detected through the sub-temperature sensor 10, is provided to the operator 131. As the second membership function TL assigns "low", "proper", or "high" to a temperature detected through the main temperature sensor 9, a second matching value f2, corresponding to the temperature detected through the main temperature sensor 9, is provided to the operator 131.

As the third membership function Paper_W assigns "narrow", "middle" or "wide" to a printing medium width detected through the printing medium width sensor 30, a third matching value f3, corresponding to the printing medium width detected through the printing medium width sensor 30, is provided to the operator 131. As the fourth membership function Num_Paper assigns "small", "middle" or "great" to the average amount of printing, calculated by the average printing amount calculation unit 152, a fourth matching value f4, corresponding to the average amount of printing received from the average printing amount calculation unit 152, is provided to the operator 131. The fifth output membership function PS assigns "fast", "middle" or "slow" to a printing speed.

The operator 131 receives the first to fourth matching values f1 to f4 for each membership function, outputs a control value fc, based on the Fuzzy control rules, and provides the printing speed setup unit 140 with printing speed setup information, to set a printing speed obtained by matching the control value fc to the fifth membership function PS.

The Fuzzy inference unit 130 designs the Fuzzy control rules, in order to adaptively set a printing speed, according to a printing environment. The following Examples 1 and 2 are examples of the Fuzzy control rules for the setup of the printing speed.

Example 1

IF TL is low, TC is high, Paper_W is middle, and Num_Paper is small, THEN PS is fast.

Example 2

IF TL is high, TC is low, Paper_W is narrow, and Num_Paper is great, THEN PS is slow.

While a continuous printing operation is being performed, the first and second matching values f1 and f2 change depending on a variation in temperature detected by the main temperature sensor 9 and the sub-temperature sensor 10. The control value of the operator 131, reflecting the first and second matching values f1 and f2, may change in response to the temperature variations. Consequently, a printing speed can be adaptively set.

When the width of a printing medium set through a user interface unit 50 is wide, but the width of a printing medium actually used is narrow, a difference between the temperature detected by the main temperature sensor 9 and the temperature detected by the sub-temperature sensor 10 is not large, in the an early stage of the printing. Accordingly, even though a printing speed is set according to normal conditions, i.e. set as a printing speed applied to a printing operation using a standardized printing medium, overheating does not occur. However, as the printing operation continues, a difference, between temperatures detected by the main temperature sensor 9 and the sub-temperature sensor 10, increases, and thus, overheating may occur. Accordingly, the printing speed is lowered, so that the internal temperature of the apparatus can be properly maintained.

Figure 5:
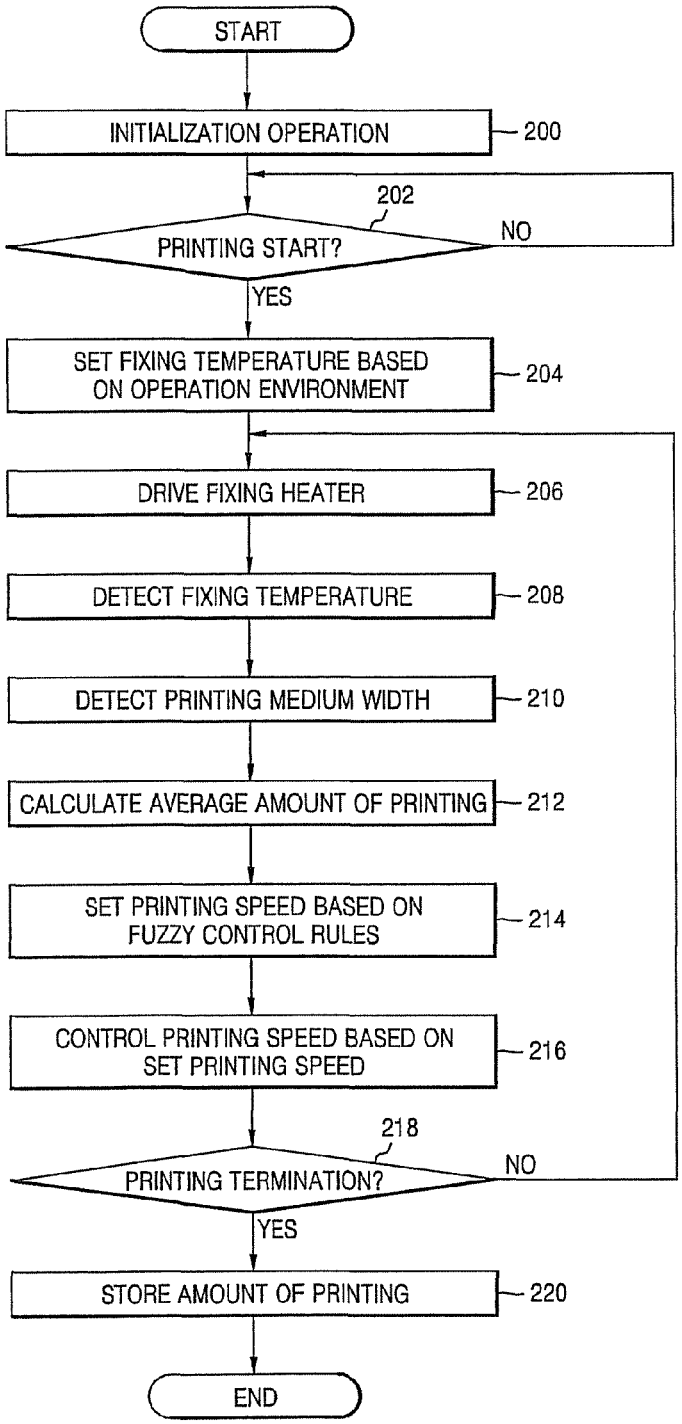
FIG. 5 is a flow diagram illustrating a control method of an image forming apparatus, according to an exemplary embodiment of the present invention.

Hereinafter, a method of controlling the image forming apparatus 11 will be described, with reference to the flow diagram of FIG. 5.

If the apparatus 11 is powered on, an initialization operation is performed, based on a control program, which is preset in order to perform a printing operation. A preheating operation for the heating roller 8*b* of the fusing unit 8 can also be performed (200).

If the initialization operation is completed, whether a user setup command for printing start is input through the user interface unit 50, is determined (202).

When it is determined that the user setup command for printing start is input, the fusing temperature setup unit 110 sets a fusing temperature, based on an operation environment and with reference to the table 111, according to resistance values of the transfer roller detected through the transfer roller resistance detector 20 (204).

The fusing temperature controller 120 receives a detected temperature of the heating roller 8*b*, from the main temperature sensor 9, and provides the fusing heater driving unit 60 with heater control signals to reach the set fusing temperature. Accordingly, the fusing heater driving unit 60 turns on or off the fusing heater 8*c* and thereby controls the heating operation (206).

While the printing operation is being performed, the main temperature sensor 9 and the sub-temperature sensor 10 detect the temperature of the central portion and the end portion of the heating roller 8*b*. The Fuzzy inference unit 130 receives detected temperature signals from the temperature sensors 9 and 10 (208).

The printing medium width sensor 30 detects the actual width of a printing medium used and provides the Fuzzy inference unit 130 with printing medium width detection signals (210).

The average printing amount calculation unit 152 calculates the average amount of printing, based on all the previous print job information stored in the printing amount storing unit 151. In some exemplary embodiments, the average printing amount calculation unit 152 calculates the average amount of printing, based on print job information relating to a number of most recent print jobs, and provides the Fuzzy inference unit 130 with information on the average amount of printing (212). For example, the number of most recent print jobs can be the previous 5, 10, 15, or 20 print jobs. The number of print job can be any suitable number of print jobs. The average printing amount calculation unit 152 can also be referred to as a printing environment information unit, which can also include the temperature detection unit 13.

The Fuzzy inference unit 130 sets a printing speed, using the matching values of each membership function, based on the Fuzzy control rules, as described in FIG. 4, and provides the printing speed setup unit 140 with the printing speed setup information (214).

The printing speed setup unit 140 sets a printing speed to drive a motor operating various rollers picking up and carrying a printing medium, and rollers for developing, transferring, and fusing functions, based on the received printing speed setup information. The printing speed setup unit 140 provides the motor driving unit 70 with the motor driving signals to reach the set printing speed. The motor driving unit 70 drives the motor. Accordingly, the printing operation is performed based on the set printing speed (216).

In an initial printing operation, a high printing speed is set. However, as the printing operation continues, overheating may occur. Specifically, in a continuous printing operation using a non-standardized printing medium, adaptively adjusting the printing speed can be important to maintaining an internal temperature.

While the continuous printing operation is being performed, whether a user setup command for printing termination is input, is determined (218). When the setup command for printing termination is not input, operation 206 is performed, such that a printing speed can be adaptively set using the Fuzzy inference unit 130. That is, as described above, the printing speed is adaptively set, based on changed in the printing environment and the operational environment, for example, the temperatures determined by the main temperature sensor and the sub-temperature sensor, the width of a printing medium, and the average amount of printing.

When the setup command for printing termination is input, information on the current amount of printing is stored in the printing amount storing unit 151. The information can be used for the calculation of the average amount of printing for a subsequent printing operation, and the procedure ends (220).

In the above exemplary embodiment, the printing medium width sensor 30 is used to detect the width of a printing medium, but the present teachings are not limited to this sensor.

The width of a printing medium, set through the user setup command, may be different from the width of a printing medium actually used. Such a difference can be recognized, based on the difference of temperatures detected by the main temperature sensor and the sub-temperature sensor.

Figure 6:
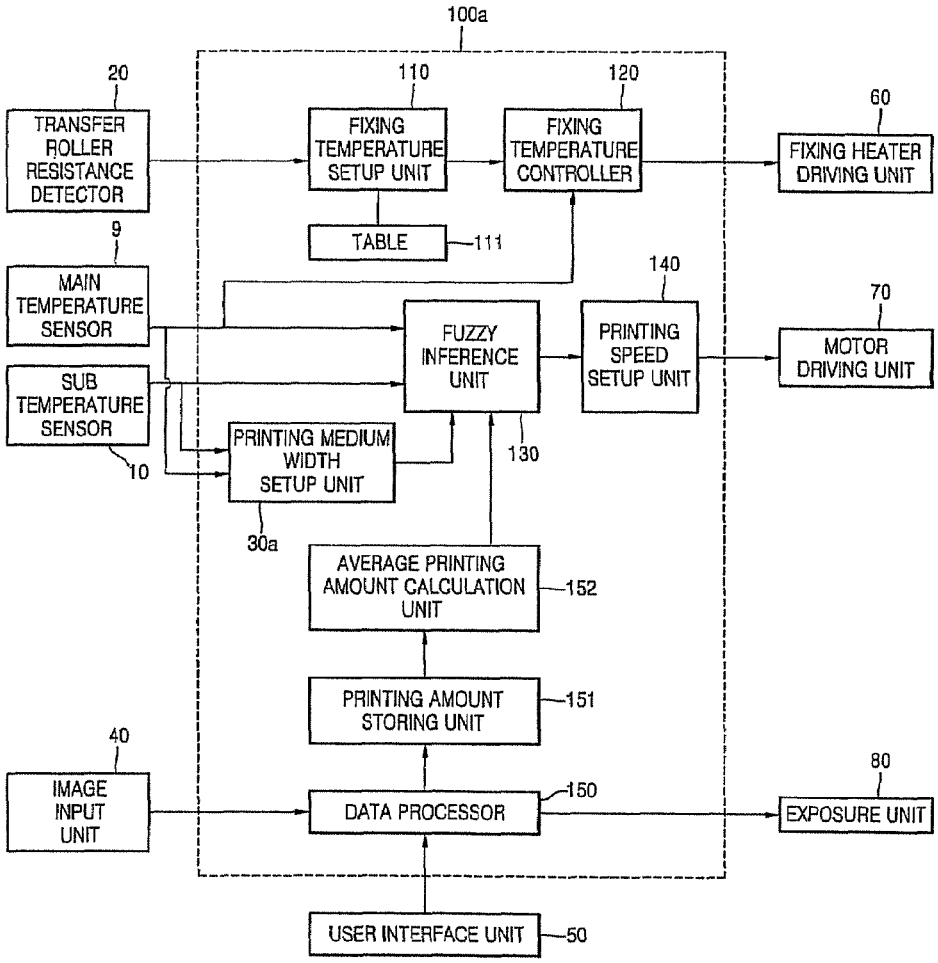
FIG. 6 is a block diagram of an image forming apparatus, according to an exemplary embodiment of the present invention.

As shown in FIG. 6, the printing medium width setup information can be provided to the Fuzzy inference unit 130, by using a printing medium width setup unit 30*a* that recognizes the width of a printing medium, based on the difference of temperatures detected by the main temperature sensor 9 and the sub-temperature sensor 10. Since a printing speed controller 100*a* is substantially identical to the printing speed controller 100, in FIG. 2, except for the printing medium width setup unit 30*a*, the same reference numerals are assigned to the same elements, and those skilled in the art can understand the same elements even though detailed description thereof is omitted.

According to aspects of the present invention, a printing speed can be controlled, based on a printing environment, and the internal temperature of an image forming apparatus can be stably maintained, so that the reliability of the image forming apparatus can be improved and convenience can be enhanced.

Although a few exemplary embodiments of the present invention have been shown and described, it would be appreciated by those skilled in the art that changes may be made in the exemplary embodiments without departing from the principles and spirit of the invention, the scope of which is defined in the claims and their equivalents.

What is claimed is:

1. An image forming apparatus, comprising:

a fusing unit;

a temperature detector to detect a temperature variation of the fusing unit;

a printing environment information unit to provide printing environment information comprising an average print job size that is calculated based on a print operation information;

a Fuzzy inference unit to calculate printing speed setup information through Fuzzy inference, using the temperature variation and the printing environment information comprising the average print job size; and a printing speed setup unit to control a printing speed of a current printing operation, based on the printing speed setup information.

2. The image forming apparatus as claimed in claim 1, wherein:

the fusing unit comprises a heating roller, to heat the printing medium; and the temperature detector comprises a main temperature sensor to detect a temperature of a central portion of the heating roller and a sub-temperature sensor to detect a temperature of an end portion of the heating roller.

3. The image forming apparatus as claimed in claim 1, wherein the printing environment information unit provides information on a width of the printing medium and an average print job size.

4. The image forming apparatus as claimed in claim 3, wherein the printing environment information unit comprises a printing medium width sensor to detect the width of the printing medium.

5. The image forming apparatus as claimed in claim 1, wherein the printing environment information unit comprises a printing medium width setup unit to determine a width of the printing medium using the temperature variation.

6. The image forming apparatus as claimed in claim 3, wherein the printing environment information unit comprises:

a printing amount storing unit to store print operation information related to print operations performed by the image forming apparatus; and an average printing amount calculation unit to calculate an average print job size based on the stored print operation information.

7. The image forming apparatus as claimed in claim 6, wherein the average printing amount calculation unit calculates the average print job size by selecting a portion of the printing information that is related to a number of the print operations most recently performed.

8. The image forming apparatus as claimed in claim 1, wherein the Fuzzy inference unit calculates the printing speed setup information using membership functions related to a temperature of a central portion of a heating roller heated by the fusing unit, a temperature of an end portion of the heating roller, a width of the printing medium, and an average print job size, and Fuzzy control rules.

9. The image forming apparatus as claimed in claim 8, wherein the Fuzzy inference unit uses the Fuzzy control rules, such that a printing speed of the current print operation is increased in an earlier stage of the current printing operation and then the printing speed is decreased in a later stage of the current printing operation, if the temperature variation is detected.

10. An image forming apparatus comprising:

a fusing unit comprising a heating roller, to fuse an image to a printing medium;

a main temperature sensor to detect a temperature of a central portion of the heating roller;

a sub-temperature sensor to detect a temperature of an end portion of the heating roller;

a printing medium width sensor to detect a width of the printing medium;

a printing amount storing unit to store print operation information relating to print operations performed by the image forming apparatus;

an average printing amount calculation unit to calculate an average print job size based on the print operation information;

a Fuzzy inference unit to calculate printing speed setup information according to membership functions and Fuzzy control rules, wherein the membership functions relate to the temperature detected by the main temperature sensor, the temperature detected by the sub-temperature sensor, the width of the printing medium, and the average print job size; and a printing speed setup unit to control a printing speed of a current printing operation, based on the printing speed setup information.

11. An image forming apparatus comprising:

a fusing unit comprising a heating roller, to fuse an image to a printing medium;

a main temperature sensor to detect a temperature of a central portion of the heating roller;

a sub-temperature sensor to detect a temperature of an end portion of the heating roller;

a printing medium width setup unit to determine a width of the printing medium based on a difference between the temperature detected by the main temperature sensor and the temperature detected by the sub-temperature sensor;

a printing amount storing unit to store print operation information relating to print operations performed by the image forming apparatus;

an average printing amount calculation unit to calculate an average print job size based on the print operation information;

a Fuzzy inference unit to calculate printing speed setup information according to membership functions and Fuzzy control rules, wherein the membership functions relate to the temperature detected by the main temperature sensor, the temperature detected by the sub-temperature sensor, the width of the printing medium, and the average print job size; and a printing speed setup unit to set a printing speed of a current print operation, based on the printing speed setup information.

12. A method for controlling an image forming apparatus that performs a print operation on a printing medium, the method comprising:

setting a fusing temperature;

heating a heating roller to the set fusing temperature;

detecting a temperature of a central portion and an end portion of the heating roller;

setting a printing speed through Fuzzy inference according to the temperatures detected by the temperature sensors, a width of the printing medium, and an average print job size of the image forming apparatus; and controlling a printing speed of the print operation based on the set printing speed.

13. The method as claimed in claim 12, wherein, the setting of the printing speed comprises applying Fuzzy control rules, such that the printing speed is increased in an earlier stage of the printing operation, and the printing speed is decreased at a later stage of the printing operation, in order to prevent the fusing temperature from exceeding the set temperature.

14. The method as claimed in claim 12, further comprising using the temperatures detected by the temperature sensors to determine the width of the printing medium.

15. The method as claimed in claim 14, wherein the width of the printing medium is determined based on a difference between the temperature of the central portion and the temperature of one end portion.

16. The method as claimed in claim 12, wherein the width of the printing medium is detected by a printing medium width sensor.

17. The method as claimed in claim 12, further comprising calculating the average print job size using stored print operation information relating to print operations previously performed by the image forming apparatus.

18. The method as claimed in claim 17, wherein the calculating of the average print job size comprises using a portion of the print operation information related to a number of the print operations most recently performed.

19. The image forming apparatus as claimed in claim 3, where the average print job size comprises an average page number of the previously performed print operations.

20. The image forming apparatus as claimed in claim 8, wherein the Fuzzy inference unit comprises an operator to apply the Fuzzy control rules to results of the membership functions to calculate the printer speed information.

21. The image forming apparatus as claimed in claim 20, wherein the operator uses an STK Fuzzy inference system to calculate the printer speed information.

22. The image forming apparatus as claimed in claim 10, wherein the average print job size comprises an average page number of the print operations.

23. The image forming apparatus as claimed in claim 11, wherein the average print job size comprises an average page number of the print operations.

24. The method as claimed in claim 12, wherein the setting of the fusing temperature comprises setting the fusing temperature according to an operational environment of the image forming apparatus.

25. The method as claimed in claim 12, further comprising repeating the setting of the printing speed until the print operation is completed or terminated.

26. An image forming apparatus, comprising:

a fusing unit;

a temperature detector to detect a temperature variation of the fusing unit;

a printing environment information unit to provide printing environment information comprising an average print job size that is calculated based on a print operation information; and a Fuzzy inference unit to calculate printing speed setup information through Fuzzy inference, using the temperature variation of the fusing unit and the printing environment information comprising the average among the printing, wherein the printing speed setup information is used to control a printing speed of a current printing operation.

* * * * *